US006607088B2

(12) United States Patent
Cestrone

(10) Patent No.: US 6,607,088 B2
(45) Date of Patent: Aug. 19, 2003

(54) BIN CARRIER ATTACHMENT FOR A PORTABLE WASTE CONTAINER

(75) Inventor: Peter A. Cestrone, Charlotte, NC (US)

(73) Assignee: P.I.C.K. Incorporated, Charlotte, NC (US)

( * ) Notice: Subject to any disclaimer, the term of this patent is extended or adjusted under 35 U.S.C. 154(b) by 0 days.

(21) Appl. No.: 09/883,744

(22) Filed: Jun. 18, 2001

(65) Prior Publication Data

US 2001/0054614 A1 Dec. 27, 2001

Related U.S. Application Data

(60) Provisional application No. 60/213,010, filed on Jun. 21, 2000.

(51) Int. Cl.[7] ..... B65D 21/02; B65F 1/00

(52) U.S. Cl. ..... 220/23.86; 220/482; 220/751; 220/909; 248/213.2; 248/326

(58) Field of Search ..... 220/482, 751, 220/23.86, 23.4, 908, 909, 643, 668, 630, 640, 629; 248/213.2, 214, 215, 101, 100, 307, 318, 339, 326; 211/88.02, 88.03, 119.008, 119.004, 119.04, 88.01; 206/504; 47/39

(56) References Cited

U.S. PATENT DOCUMENTS 2,061,937 A * 11/1936 Fay ..... 211/49.1
2,098,374 A * 11/1937 Bullock ..... 248/94
2,235,182 A * 3/1941 Weston ..... 248/100
3,799,228 A * 3/1974 Crawford ..... 220/9.2
4,196,880 A * 4/1980 Hynes ..... 248/99
4,768,742 A * 9/1988 Kaaloa ..... 248/99
4,949,924 A * 8/1990 Carmody ..... 248/215
5,009,377 A * 4/1991 Mangeruga ..... 248/231.81
5,092,480 A * 3/1992 Waterston ..... 220/23.4
5,118,059 A * 6/1992 Mainer ..... 248/215
5,125,605 A * 6/1992 Guerrera ..... 248/100
5,170,903 A * 12/1992 Fleming ..... 220/23.4
5,180,126 A * 1/1993 Bennett ..... 248/99
5,215,200 A * 6/1993 Rosenthal ..... 211/187
5,713,499 A * 2/1998 Daniel ..... 224/401
5,738,319 A * 4/1998 Grassi ..... 248/215
6,050,532 A * 4/2000 Paul ..... 248/214
6,092,767 A * 7/2000 Schrager ..... 248/98
6,164,607 A * 12/2000 Hawkes ..... 141/391

* cited by examiner

*Primary Examiner*—Lee Young
*Assistant Examiner*—Joseph C. Merek
(74) *Attorney, Agent, or Firm*—Schwartz Law Firm, P.C.

(57) ABSTRACT

A bin carrier attachment is provided for a portable waste container. The attachment includes a mounting member adapted for securing the attachment to the waste container. A bin support member is attached to the mounting member, and is adapted for supporting a separate bin used for containing articles outside of the waste container. The waste container and bin are movable together in a single trip between a storage site and a waste collection site.

6 Claims, 5 Drawing Sheets

BIN CARRIER ATTACHMENT FOR A PORTABLE WASTE CONTAINER

TECHNICAL FIELD AND BACKGROUND OF THE INVENTION

This invention relates to a bin carrier attachment for use with a portable rollout waste container. The invention is intended to promote recycling by reducing the effort and certain inconveniences required to participate in municipal recycling programs.

Typical household waste collection takes place by driving a collection truck along a collection route. On specified days residents roll their wheeled containers out to the street curb to be emptied. Those residents choosing to recycle sort their recyclable items, and store them in separate bins positioned at the curbside next to the waste container for collection.

The importance of recycling and the expense of disposing of household and business refuse has created a demand for greater participation in municipal recycling efforts. Most municipalities provide free bins to households so that recyclable items can be conveniently sorted and stored prior to collection. Some municipalities, business concerns, and schools have instituted incentive programs to encourage conservation and recycling. Despite such efforts, the overall percentage of households which consistently recycle remains low.

A contributing cause for this lack of participation is the physical effort and inconvenience of transporting multiple containers from the home to the curbside. While the rollout waste container is relatively easy to move, the recycle bins are often heavy and must be lifted and carried separately in a second or even third trip. For many residents, the need alone to make multiple trips from the home to the curb is enough to discourage recycling. The present invention resolves these inconveniences by enabling the transport of recyclable items contained in one or more separate bins together with the waste container from the home to the curbside in a single trip.

SUMMARY OF THE INVENTION

Therefore, it is an object of the invention to provide a bin carrier attachment adapted for use with a portable rollout waste container, and for holding a recycle bin such that users need make only a single trip from the home to the street curb when transporting their waste and recyclable items for collection.

It is another object of the invention to provide a bin carrier attachment which is relatively inexpensive to manufacture.

It is another object of the invention to provide a bin carrier attachment which is relatively lightweight.

It is another object of the invention to provide a bin carrier attachment which is durable.

It is another object of the invention to provide a bin carrier attachment which is easily removed from and applied to the waste container without damaging the walls of the container.

It is another object of the invention to provide a bin carrier attachment which is adjustable to fit bins of different sizes.

It is another object of the invention to provide a bin carrier attachment which does not interfere with the normal collection of waste in the waste container.

It is another object of the invention to provide a bin carrier attachment which is capable of supporting a load of up to 50 lbs.

It is another object of the invention to promote recycling.

It is another object of the invention to enable the transport of multiple bins together with the rollout waste container from the home to the street curb in a single trip.

It is another object of the invention to reduce the physical effort required to transport recycle bins to the street curb for collection.

It is another object of the invention to make it difficult for pests to enter into the recycle bin at the storage site near the home.

It is another object of the invention to provide a method for promoting recycling.

These and other objects of the present invention are achieved in the preferred embodiments disclosed below by providing a bin carrier attachment for a portable waste container. The attachment includes a mounting member adapted for securing the attachment to the waste container. A bin support member is attached to the mounting member, and is adapted for supporting a separate bin used for containing articles outside of the waste container. The waste container and bin are movable together in a single trip between a storage site and a waste collection site. The term "bin" is defined broadly herein to include any container, such as a plastic box, frame, or bag, used for storage.

According to another preferred embodiment of the invention, the mounting member includes a pair of spaced-apart hangers adapted for extending over a rim of the waste container.

According to another preferred embodiment of the invention, the bin support member includes a support frame defining an opening adapted for receiving and supporting a bin.

According to another preferred embodiment of the invention, the support frame includes cooperating pairs of parallel side frame members and parallel front and rear frame members integrally formed with the side frame members.

According to another preferred embodiment of the invention, the mounting member and the bin support member are formed of plastic.

According to another preferred embodiment of the invention, the mounting member and the bin support member are formed of metal.

According to another preferred embodiment of the invention, the mounting member and the bin support member are formed of aluminum.

In another embodiment, the invention is a method of transporting sorted waste and recyclable articles in a single trip between a storage site and a waste collection site. The method includes the step of securing a bin carrier attachment to a portable waste container. A separate bin is then positioned within the bin carrier attachment for containing the recyclable articles. The waste container and bin are then transported in a single trip between the storage site and the waste collection site.

According to another preferred embodiment of the invention, method includes securing a plurality of bin carrier attachments to the portable waste container for transporting a corresponding plurality of bins together with the waste container between the storage site and the waste collection site.

In another embodiment, the invention is a combination portable waste container and a bin carrier attachment. The bin carrier attachment includes a mounting member removably securing the attachment to the waste container. A bin support member is attached to the mounting member, and is adapted for supporting a separate bin used for containing articles outside of the waste container. The waste container and bin are movable together in a single trip between a storage site and a waste collection site.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
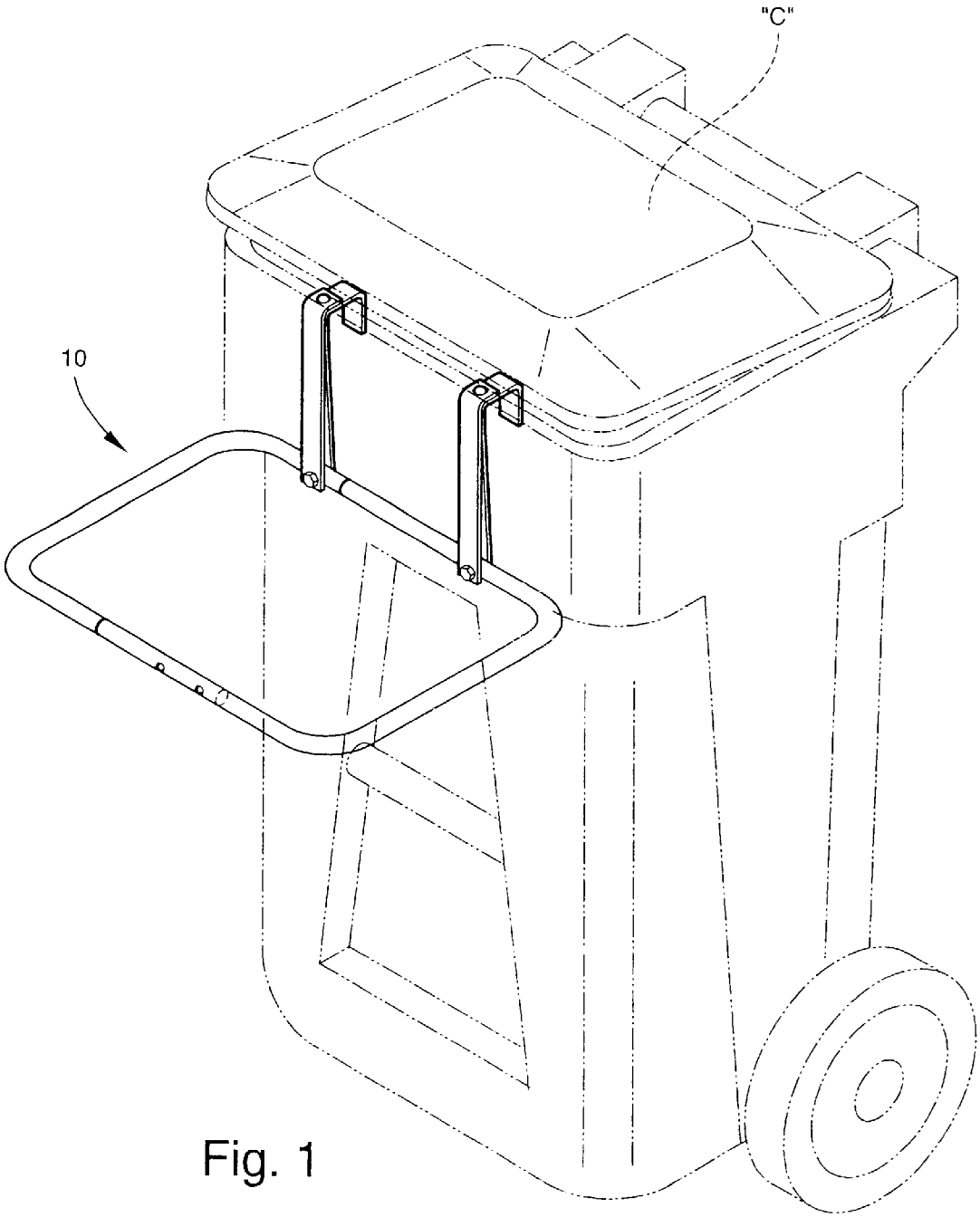
FIG. 1 is an environmental perspective view of a bin carrier attachment according to one preferred embodiment of the invention, and showing the attachment secured to a rollout waste container (in phantom)

Referring now specifically to the drawings, a bin carrier attachment according to the present invention is illustrated in FIG. 1 and shown generally at reference numeral 10. The attachment 10 is especially adapted for use on a residential, rollout waste container "C". The attachment 10 is designed to hold a recycle bin "B" (See FIGS. 4 and 6) used for storing recyclable items, such that the rollout waste container "C" and recycle bin "B" can be conveniently transported together in a single trip between a storage site near the home and a collection site near the street curb. It is understood that the attachment 10 may be used for carrying bins of any size and shape including those suitable for storing yard debris, such as leaves, fallen branches, and the like.

Figure 2:
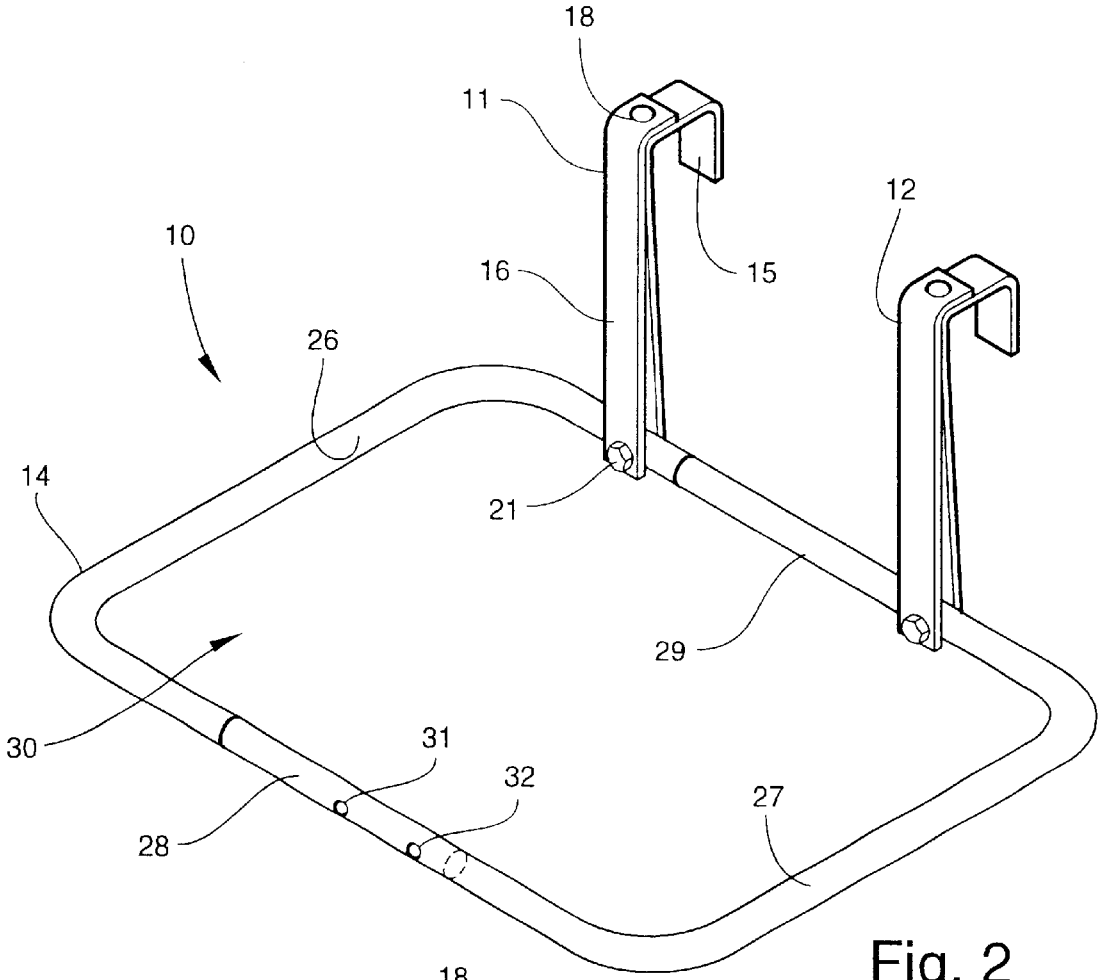
FIG. 2 is a perspective view of the bin carrier attachment.
Figure 3:
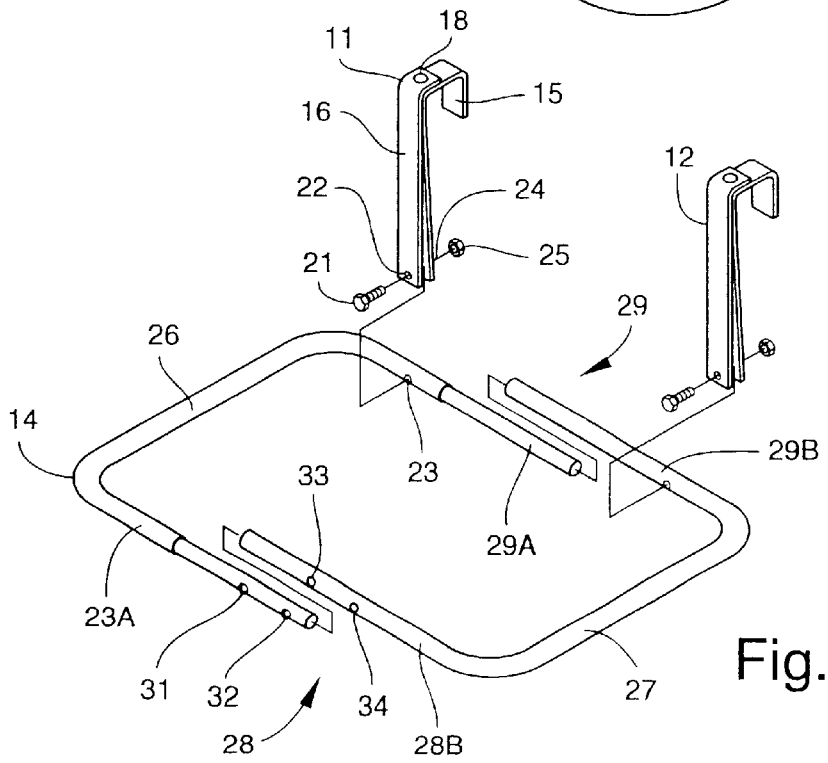
FIG. 3 is a perspective view of the bin carrier attachment with certain components of the attachment removed and exploded away.

Referring to FIGS. 2 and 3, the bin carrier attachment 10 includes cooperating metal hangers 11 and 12 for being secured to the rim of the waste container "C". The opposite ends of the hangers 11, 12 are attached to a bin support frame 14. Each hanger 11, 12 includes an elongated hook 15 and a generally L-shaped bracket 16. The top end of the bracket 16 is permanently attached to the hook 15 using a metal rivet 18 or other suitable means such as welding. The bottom ends of the hook 15 and bracket 16 are attached on opposite sides of the bin support frame 14 by a threaded bolt 21 extending through aligned holes 22, 23, and 24 and secured in place with a complementary-threaded nut 25. Hanger 12 includes identical elements, and is attached in an identical manner.

The bin support frame 14 includes integrally-formed parallel side frame members 26 and 27 and parallel front and rear frame members 28 and 29. The frame members 26-29 cooperate to define a bin-receiving opening 30. As shown in FIG. 3, the bin support frame 14 is preferably formed in separate halves. The front and rear frame members 28 and 29 include telescoping segments 28A, 28B and 29A, 29B which enable adjustment of the bin-receiving opening 30 to fit recycle bins "B" of different sizes. The smaller diameter segment 28A includes spring-loaded buttons 31 and 32 which align and mate with at least one of the holes 33 and 34 formed in the larger diameter segment 28B to releasably lock the frame 14 in the desired position.

According to one embodiment, the length of the bin-receiving opening 30 is adjustable from 15 to 26 inches with the width being set between 16 and 20 inches. The length of each hanger 11, 12 is between 10 and 14 inches. The bend of the hook 15 extends outwardly between 2 and 5 inches. The distance between the hangers 11, 12 is between 8 and 14 inches. The bin support frame 14 is preferably constructed of a lightweight metal, such as aluminum. In another embodiment, the hangers and bin support frame are formed of plastic.

Figure 4:
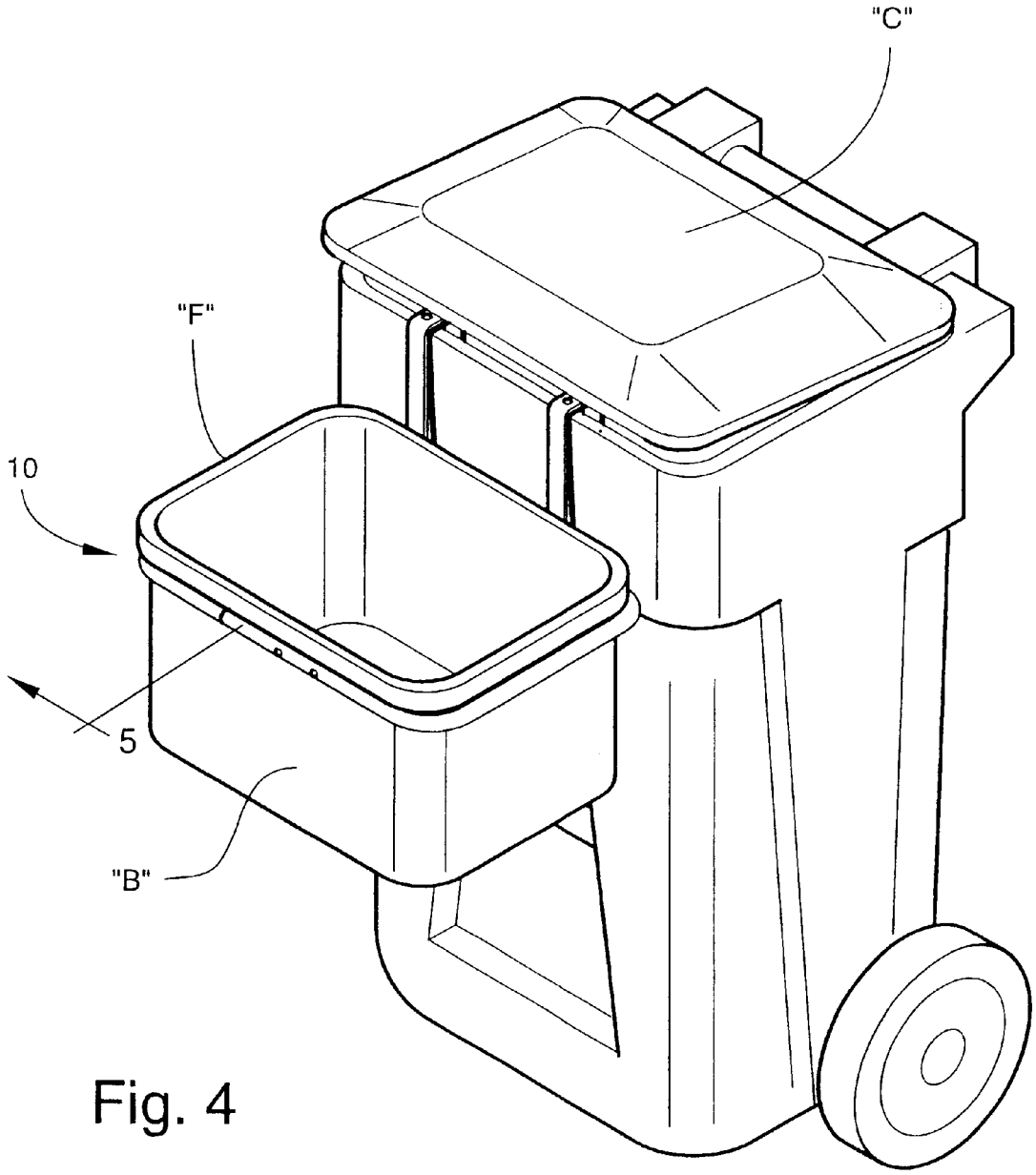
FIG. 4 is a perspective view of the bin carrier attachment secured to a rollout waste container and holding a recycle bin.
Figure 5:
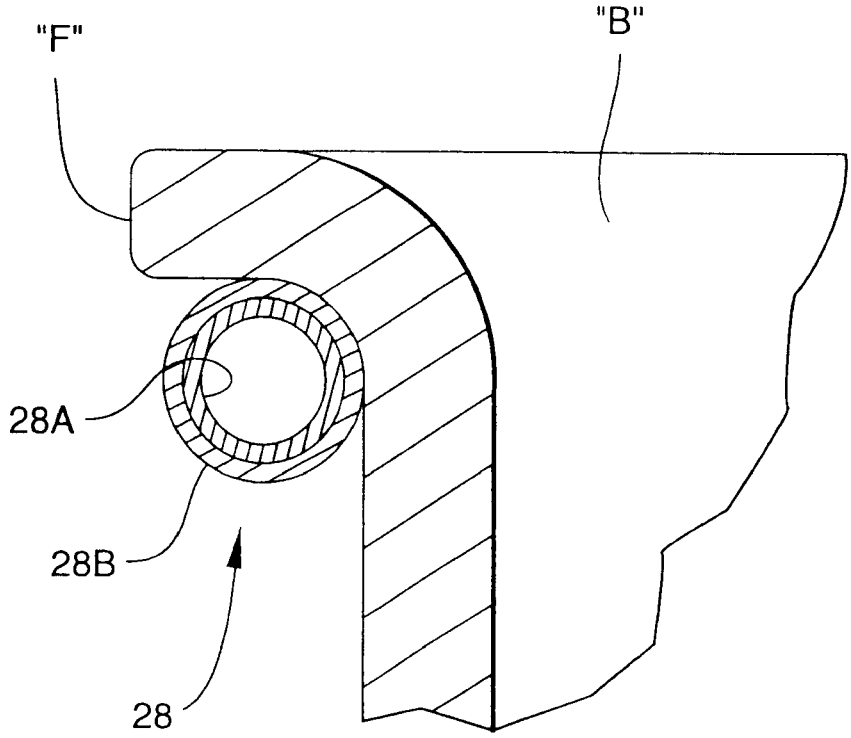
FIG. 5 is a fragmentary cross-section taken substantially along line 5 shown in FIG. 4.
Figure 6:
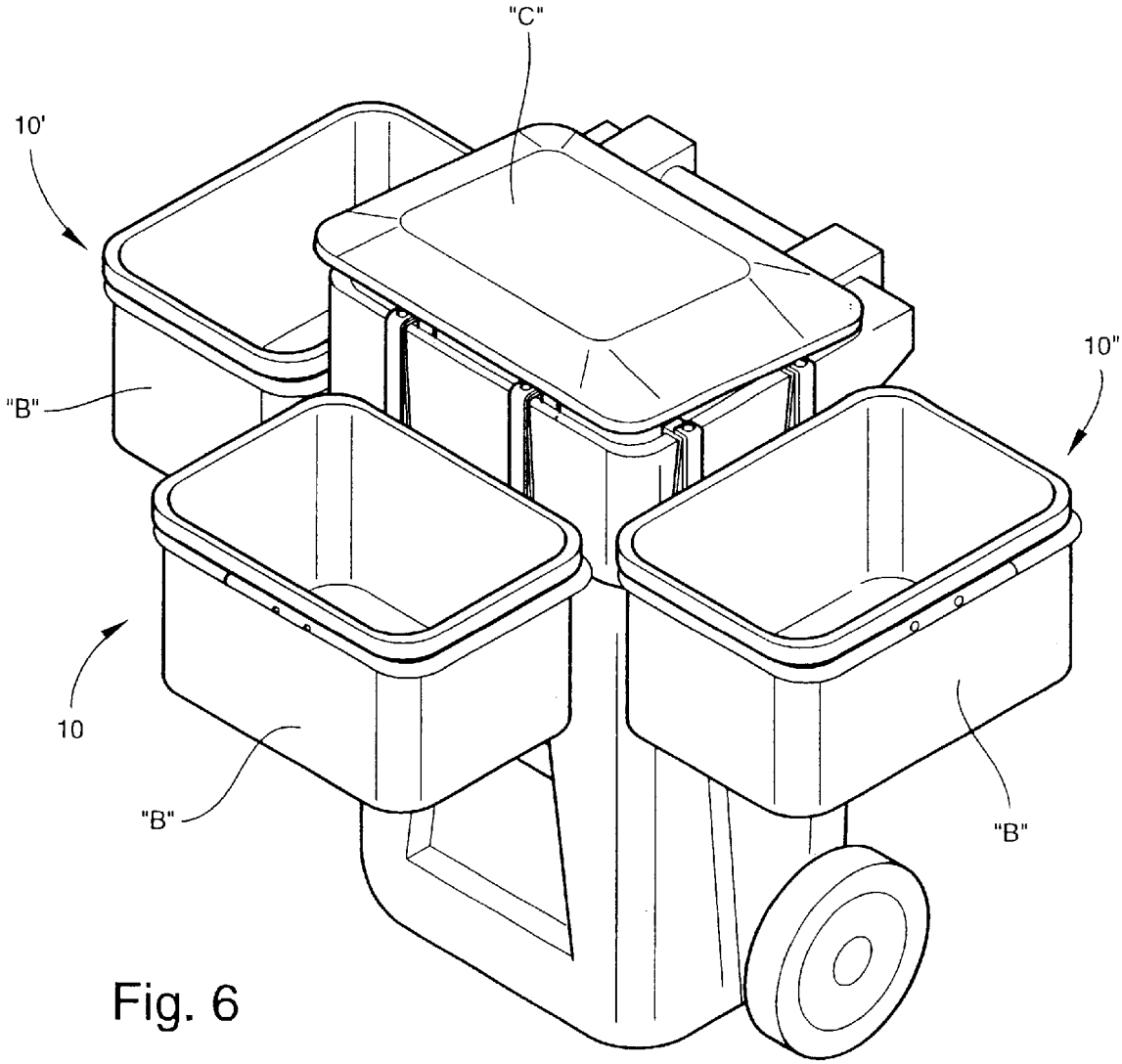
FIG. 6 is a perspective view of a rollout waste container with three bin carrier attachments holding three recycle bins.

FIG. 4 illustrates the bin carrier attachment 10 hung from the rim of the rollout waste container "C", and carrying a standard recycle bin "B". The recycle bin "B" is positioned within the bin-receiving opening 30 (See FIG. 2) of the support frame 14, and includes an outwardly-extending perimeter flange "F" which engages two or more of the front, rear, and side frame members 26–29. FIG. 5 shows the positioning of the flange "F" relative to the front frame member 28. After transport to the curb, the recycle bin "B" is readily lifted from the bin-receiving opening 30 and placed beside the waste container "C" for collection. The bin carrier attachment 10 is then removed from the waste container "C", and later reused when retrieving the waste container "C" and bin "B" from the curb. The emptied bin "B" is placed back in the bin-receiving opening 30 of the support frame 14 and transported together with the waste container "C" from the collection site back to the storage site. The bin "B" may remain suspended above the ground in the position shown in FIG. 4 at the storage site in order to keep pests away from the recyclable items, and to promote drainage of any liquid inside the bin. For those communities which separate and collect recyclable items in multiple bins "B", two or three of the attachments 10, 10!, and 10" may be used on a single rollout waste container "C", as shown in FIG. 6.

A bin carrier attachment for a rollout waste container is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. A bin carrier attachment combination with a portable waste container and a bin for containing articles, the combination comprising:

(a) a mounting hanger engaging said waste container and holding said attachment thereto;

(b) a bin support member attached to said mounting hanger and comprising an adjustable support frame, said support frame comprising:

(i) first and second parallel side frame members;

(ii) parallel front and rear frame members joined to said side frame members, and comprising respective front and rear pairs of telescoping segments adapted for telescoping inward and outward adjustment; and (iii) said side frame members and said front and rear frame members cooperating to form an adjustable closed-end structure defining a bin-receiving opening adapted for receiving said bin used for containing articles outside of said waste container, the size of said bin-receiving opening being adjustable upon telescoping movement of said front and rear frame members, such that a portion of the bin rests on said support frame to support the bin within said bin carrier attachment without penetration of said support frame through walls of the bin, whereby said waste container and bin are movable together in a single trip between a storage site and a waste collection site.

2. A combination according to claim 1, wherein said mounting hanger comprises a hook adapted for extending over a rim of the waste container.

3. A combination according to claim 1, wherein said mounting hanger and said support frame are formed of plastic.

4. A combination according to claim 1, wherein said mounting hanger and said support frame are formed of metal.

5. A combination according to claim 1, wherein said mounting hanger and said support frame are formed of aluminum.

6. A combination according to claim 1, wherein one telescoping segment of the front pair comprises a depressable button adapted for mating alignment with a complementary hole formed in the other telescoping segment of the front pair, thereby releasably locking said adjustable support frame in a desired fixed position.

* * * * *